US008206134B2

(12) United States Patent
Moldovan et al.

(10) Patent No.: US 8,206,134 B2
(45) Date of Patent: Jun. 26, 2012

(54) COMBINED POWER PACK UNIT

(75) Inventors: Ion Moldovan, Cleveland, OH (US); Paul Ellsworth, Richfield, OH (US)

(73) Assignee: Maradyne Corporation, Cleveland, OH (US)

( * ) Notice: Subject to any disclaimer, the term of this patent is extended or adjusted under 35 U.S.C. 154(b) by 1059 days.

(21) Appl. No.: 12/131,477

(22) Filed: Jun. 2, 2008

(65) Prior Publication Data

US 2009/0297370 A1 Dec. 3, 2009

(51) Int. Cl.
*F04B 23/04* (2006.01)
*F04B 41/06* (2006.01)

(52) U.S. Cl. ..... 417/427; 417/62; 417/286; 137/565.19; 137/565.29; 137/565.33; 60/468

(58) Field of Classification Search ..... 417/62, 417/286, 426, 427; 60/468, 475, 486; 137/565.19, 137/565.29, 565.33; 418/8, 5, 6, 60
See application file for complete search history.

(56) References Cited

U.S. PATENT DOCUMENTS

| | | | | |
|---|---|---|---|---|
| 2,243,918 | A * | 6/1941 | Parker | 417/286 |
| 2,455,271 | A * | 11/1948 | Raymond | 137/114 |
| 3,255,806 | A | 6/1966 | Meyer et al. | |
| 3,503,223 | A * | 3/1970 | Parker | 62/510 |
| 3,603,206 | A | 9/1971 | Quackenbush | |
| 3,773,117 | A | 11/1973 | Dussel | |
| 4,252,508 | A | 2/1981 | Forster | |
| 4,296,677 | A | 10/1981 | Little et al. | |
| 4,508,015 | A | 4/1985 | Lin | |
| 4,543,938 | A * | 10/1985 | Szlaga | 123/514 |
| 4,731,886 | A | 3/1988 | Heinrich et al. | |
| 4,765,225 | A | 8/1988 | Birchard | |
| 5,078,222 | A | 1/1992 | Hauser et al. | |
| 5,117,633 | A | 6/1992 | Bayer et al. | |
| 5,181,837 | A | 1/1993 | Niemiec | |
| 5,211,031 | A * | 5/1993 | Murayama et al. | 62/498 |
| 5,219,275 | A | 6/1993 | Ribaudo | |
| 5,304,043 | A | 4/1994 | Shilling | |
| 5,466,131 | A | 11/1995 | Altham et al. | |
| 5,800,134 | A | 9/1998 | Hasegawa et al. | |
| 6,205,780 | B1 * | 3/2001 | Zervas | 60/421 |
| 6,234,060 | B1 | 5/2001 | Jolly | |

(Continued)

FOREIGN PATENT DOCUMENTS

JP 10025773 A * 1/1998

OTHER PUBLICATIONS

Derwent-JP-10025773-A (Derwent abstract for JP-10025773-A).*

*Primary Examiner* — Devon C Kramer
*Assistant Examiner* — Thomas Fink
(74) *Attorney, Agent, or Firm* — Fay Sharpe LLP

(57) ABSTRACT

A power pack unit includes a first hydraulic pump including a first pump enclosure accommodating a first pump cartridge. A second hydraulic pump includes a second pump enclosure accommodating a second pump cartridge. A hydraulic fluid reservoir is positioned between the first and second hydraulic pumps. A first end of the reservoir is secured to the first pump enclosure and a second end of the reservoir is secured to the second pump enclosure. The first and second hydraulic pumps and the reservoir can extend along a common axis. First and second motors can be connected to the first and second pumps. The entire structure can extend along a common axis.

11 Claims, 9 Drawing Sheets

U.S. PATENT DOCUMENTS

| | | | | |
|---|---|---|---|---|
| 6,361,282 | B1 | 3/2002 | Wanschura | |
| 6,675,698 | B1 | 1/2004 | Shteynberg | |
| 6,705,840 | B1 | 3/2004 | Hauser et al. | |
| 6,746,218 | B2 | 6/2004 | Heller | |
| 6,793,463 | B1 | 9/2004 | Ward | |
| 6,979,185 | B2 * | 12/2005 | Kaempe | 418/131 |
| 7,028,491 | B2 * | 4/2006 | Horton | 62/158 |
| 7,107,814 | B2 | 9/2006 | Winterhalter et al. | |
| 7,108,324 | B2 | 9/2006 | Lambrecht et al. | |
| 7,174,828 | B2 | 2/2007 | Davies et al. | |
| 7,182,583 | B2 | 2/2007 | Gandrud et al. | |
| 2006/0144446 | A1 * | 7/2006 | Inagaki | 137/561 R |
| 2007/0029118 | A1 * | 2/2007 | Acharya et al. | 180/53.4 |
| 2007/0119160 | A1 | 5/2007 | Menze | |

* cited by examiner

COMBINED POWER PACK UNIT

BACKGROUND

The present disclosure relates to hydraulic power units. Such power units generally employ an electric motor driving a hydraulic pump.

Hydraulic power units are employed in a wide variety of applications. Such units provide pressurized flow to hydraulic motors, cylinders and other hydraulic components. Hydraulic power units differ from pumps because a hydraulic power unit contains a fluid reservoir, an electric motor, as well as a hydraulic pump stage driven by the electric motor. They may also include coolers to keep the hydraulic fluid at a safe working temperature. Performance specifications, physical characteristics and features are all important parameters to consider when evaluating hydraulic power units.

It is common to provide an electric motor in one housing and a hydraulic pump in another housing, with the two housings being positioned in line so that the motor and pump each have their own sets of bearings and shafts that are usually engaged through internal and external splines or through flexible couplings.

The electric motor driving the hydraulic pump can be either AC powered or DC powered. Typical applications for such power units include aerial platforms, car hoists, compactors, dock levelers, exercise equipment, factory automation and parking systems. Hydraulic power units can also be used in vehicle applications, such as, for example, opening or closing vehicle body components such as doors, hoods, tail gates or the like. In addition, they can be used for controlling the movement of snowplows attached to vehicles, such as all terrain vehicles (ATVs). In some spaced-limited applications, such as in vehicles, there is not enough room for two separate power units. Therefore, it would be advantageous to provide a compact power unit which accommodates space constraints but also meets power requirements.

BRIEF DESCRIPTION

One aspect of the present disclosure relates to a power pack unit comprising a first hydraulic pump comprising a first pump enclosure accommodating a first pump cartridge and a second hydraulic pump comprising a second pump enclosure accommodating a second pump cartridge. A hydraulic fluid reservoir is positioned between the first and second hydraulic pumps. A first end of a reservoir is secured to the first pump enclosure and a second end of the reservoir is secured to the second pump enclosure.

According to another aspect of the present disclosure, a power pack unit is provided. In accordance with this aspect of the disclosure, the power pack unit comprises a first hydraulic pump and a first motor which drives the first hydraulic pump. Also provided is a second hydraulic pump and a second motor which drives the second hydraulic pump. A hydraulic fluid reservoir is positioned between and communicates with the first and second hydraulic pumps. The first and second hydraulic pumps and the reservoir and the first and second motors extend along a common axis.

In accordance with a further aspect of the present disclosure, there is provided a hydraulic drive system for powering a hydraulic actuator. More particularly, in accordance with this aspect of the disclosure, the drive system comprises a first hydraulic pump driven by a first motor and a second hydraulic pump driven by a second motor. Also provided is an actuator assembly. A hydraulic circuit interconnects the hydraulic actuator with the first and second hydraulic pumps. Also provided is a control system which enables the hydraulic actuator assembly to be selectively driven by one of the first and second hydraulic pumps or by both the first and second hydraulic pumps, thereby affording both redundancy and variable drive speeds to the drive system.

In accordance with a still further aspect of the present disclosure, there is provided a hydraulic drive system comprising a first hydraulic pump driven by a first motor and a second hydraulic pump driven by a second motor. A hydraulic reservoir is located between and in communication with the first hydraulic pump and the second hydraulic pump wherein the hydraulic reservoir and the first and second hydraulic pumps are axially aligned. A first hydraulic actuator assembly communicates with the first hydraulic pump. A second hydraulic actuator assembly communicates with the second hydraulic pump. At least one control system enables the first and second hydraulic pumps to operate independently and actuate the first and second hydraulic actuators independently of each other.

BRIEF DESCRIPTION OF THE DRAWINGS

The disclosure may take physical form in certain parts and arrangements of parts, several embodiments of which will be described in detail in this specification and illustrated in the accompanying drawings which form a part hereof and wherein.

DETAILED DESCRIPTION

Figure 1:
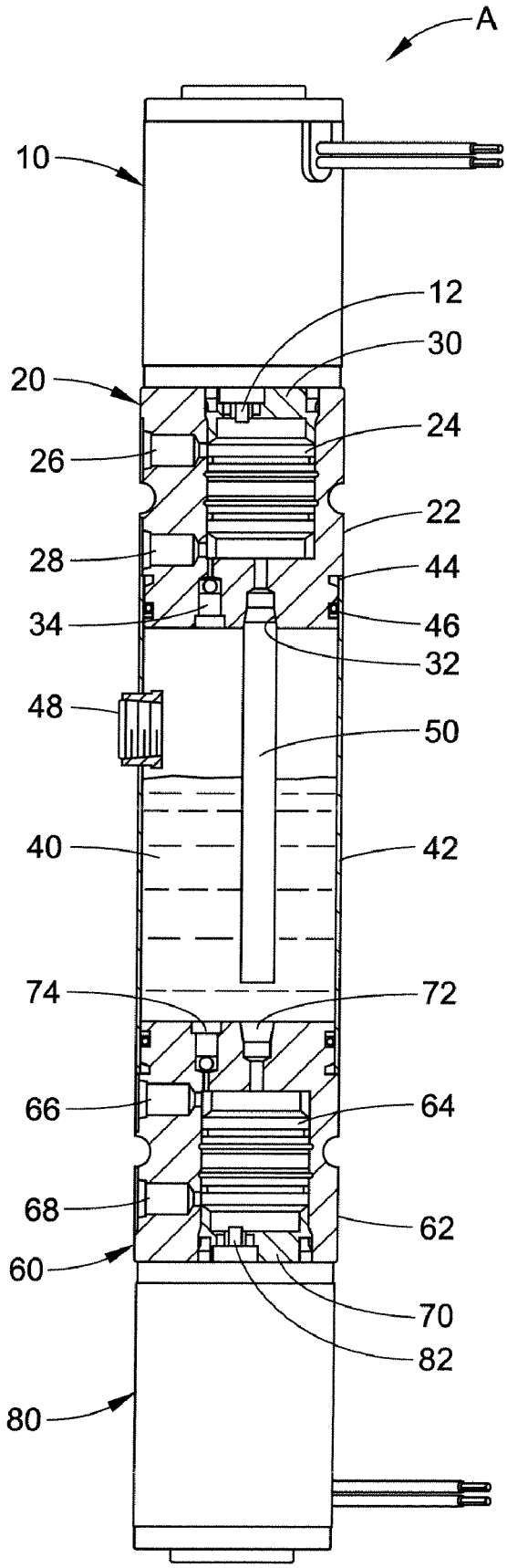
FIG. 1 is a front elevational view, partially in cross section, of a power pack unit according to a first embodiment of the present disclosure.

Referring now to the drawings, wherein the showings are for purposes of illustrating the several embodiments of the present disclosure only and not for purposes of limiting same, FIG. 1 shows a first embodiment of a power pack unit A. In this embodiment, there is provided a first electric motor 10. Communicating therewith is a drive shaft 12 of a first or upper pump assembly 20. If so desired, the first pump may be a hydraulic pump. The first pump assembly comprises a pump enclosure 22 which includes an internal cavity and a pump cartridge 24 disposed therein. The pump cartridge can be, for example, a compact, bi-directional pump capable of pressurizing hydraulic fluid in two opposite directions by rotation of the pump in two opposite directions. One embodiment of such a pump is illustrated in U.S. Pat. No. 6,979,185 dated Dec. 27, 2005. The disclosure of this patent is incorporated hereinto by reference in its entirety. Disclosed therein is a compact bi-rotational gear pump for pressurizing hydraulic fluid that can be used to move a piston in a cylinder.

Communicating with the pump cartridge 24 are pressure/return ports 26 and 28 located in a spaced manner on the pump enclosure 22. The ports 26 and 28 will serve as either pressure ports or return ports depending upon the direction of rotation of the bi-rotational gear pump. Also mounted to the pump enclosure is a pump retainer 30 (see FIG. 2). Located on the pump enclosure is a reservoir suction port 32, and, spaced therefrom, a conventional relief valve 34. A reservoir 40 is connected to the pump enclosure 22. The reservoir comprises a cylindrical or tubular housing 42 which is secured by crimping 44 to the pump enclosure 22 and is sealed to the pump enclosure by suitable conventional seals 46. Of course, other known ways of connecting the housing to the pump enclosure could also be used. Located in the housing 42 is a fill port 48. Extending into the reservoir 40 is a suction tube 50 connected at a proximal end to the reservoir suction port 32 of pump enclosure 22. It should be appreciated that this embodiment of the power pack unit is vertically oriented, hence the need for the suction tube 50. If the power pack unit were meant for a horizontal orientation, such a suction tube may not be necessary. It should be appreciated that as hydraulic fluid is necessary for the pump assembly 20, it is drawn from the reservoir 40 through the tube 50 and into the pump enclosure 22 via the reservoir suction port 32. If there is an overpressure situation in the pump, hydraulic fluid can be relieved back into the reservoir 40 via relief valve 34.

Figure 2:
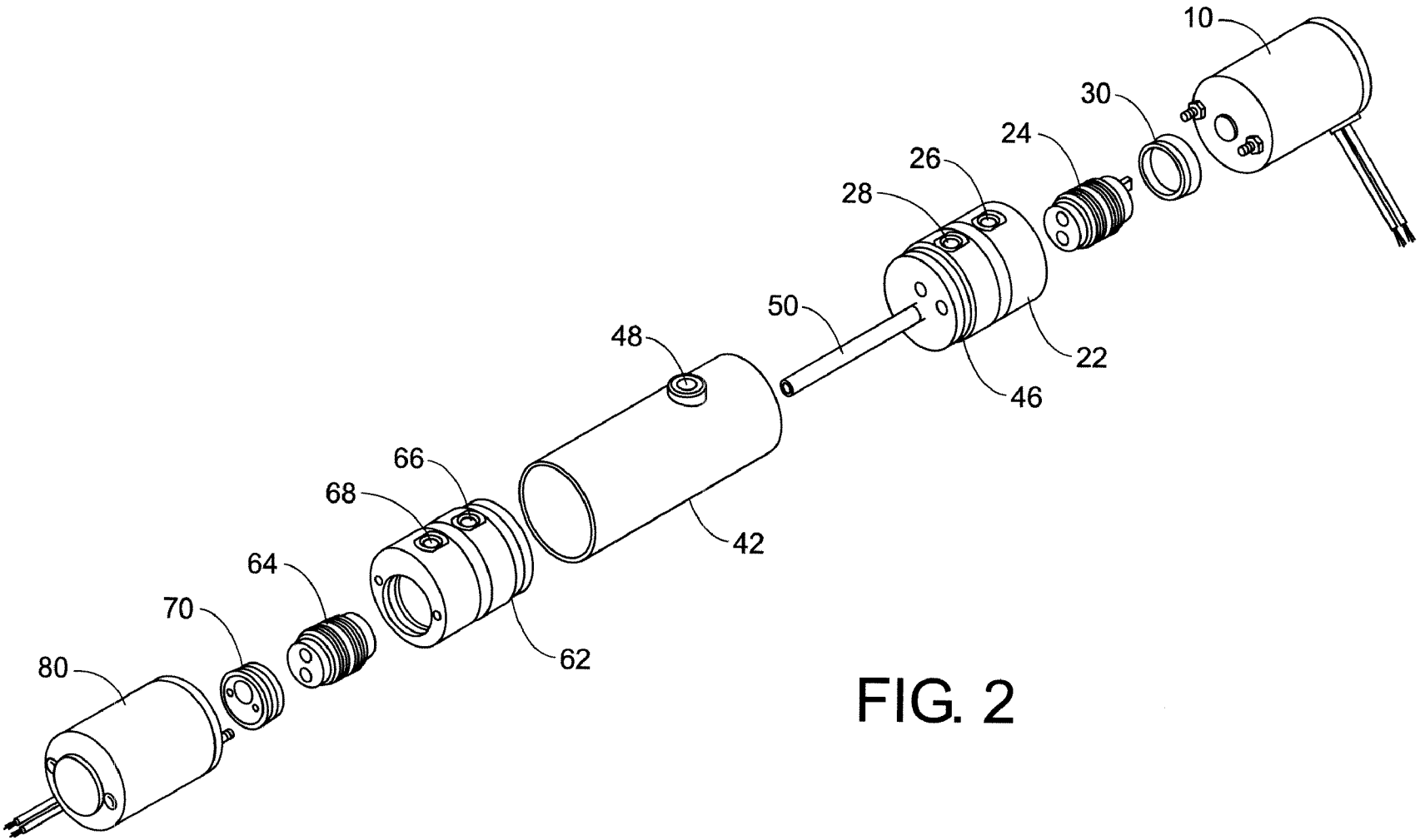
FIG. 2 is an exploded perspective view of the power pack unit of FIG. 1.

Disposed on a distal end of the reservoir 40 is a second or lower pump assembly 60. The second pump comprises a pump enclosure 62 in which there is positioned a pump cartridge 64. The pump cartridge can, similarly, be a bi-directional pump cartridge such as is disclosed in the U.S. Pat. No. 6,979,185 mentioned above. Located in the pump enclosure 62 are spaced first and second ports 66 and 68, which can be pressure ports or return ports, depending upon the direction of pumping of the bi-directional pump cartridge 64. Connected to the pump enclosure 62 is a pump retainer 70 (FIG. 2). Also provided on the pump enclosure is a suction port 72, as well as a relief valve 74, spaced therefrom. Powering the second pump 60 is a second electric motor 80. To this end, a drive shaft 82 of the pump is physically engaged with a suitable socket on the motor 80.

Figure 3:
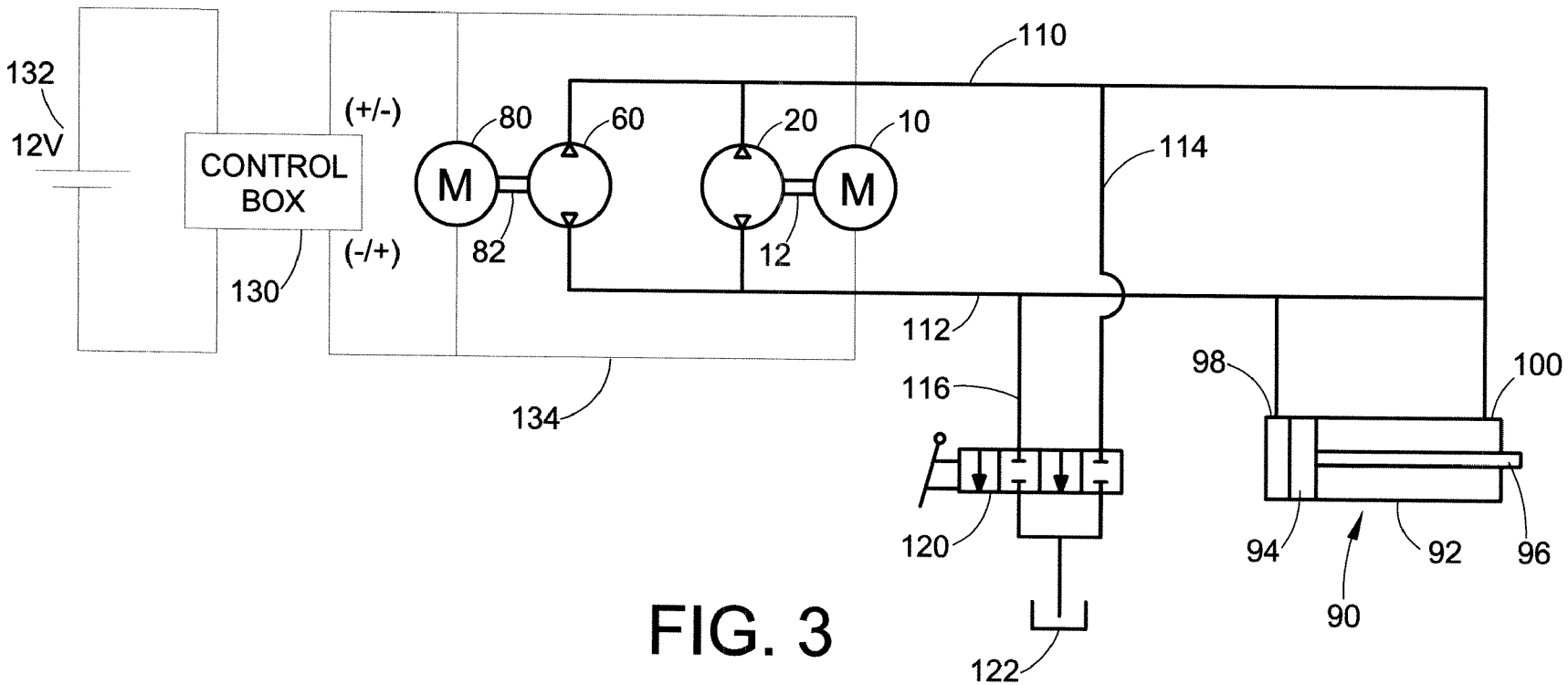
FIG. 3 is a hydraulic and electrical circuit diagram of the power pack unit of FIG. 1 when connected to a hydraulic piston and cylinder assembly.

With reference now to FIG. 3, there is shown a hydraulic cylinder 90 in the form of a piston and cylinder unit which is selectively actuated by the power pack unit. The cylinder 90 comprises a tube 92 in which there is positioned a piston head 94 that can move axially in the tube. The piston head is connected to a piston rod or actuator rod 96 having a distal end which extends out of the cylinder. Provided on the cylinder is a first port 98 which is disposed proximal of the piston head 94 and a second port 100 which is disposed distal of the piston head.

A first hydraulic fluid line 110 communicates the first and second pumps 20 and 60 with the second port 100. A second hydraulic fluid line 112 communicates the first and second pumps 20 and 60 with the first port 98. Thus, hydraulic fluid can be provided either through the first port 98 or through the second port 100 thereby moving the piston head 94 in a desired direction and, in this way, moving the piston rod or actuator rod 96 as necessary. In this way, the piston rod can be used to actuate a desired component of the system to which the cylinder is connected. A third fluid line 114 and a fourth fluid line 116 respectively communicate the first and second fluid lines 110 and 112 with a relief valve 120. This can be a manual relief valve if so desired. The relief valve allows hydraulic fluid to selectively flow into a sump 122. The sump may be different from, or the same as, the common reservoir 40 illustrated in FIG. 1.

A control box 130 includes suitable controls for actuating the first and second motors 10 and 80 and, hence, powering the first and second hydraulic pumps 20 and 60. The control box electrically communicates with a power supply 132. It also electrically communicates with the first and second pumps 10 and 80 via suitable electric lines 134. The construction is such that an instant and positive change in direction of the piston 94 is achieved by appropriate actuation of the electric drive motors 10 and 80. Such actuation is controlled by the control box 130. As with most controllers these days, the control box 130 can include a microprocessor.

It should be appreciated that a single one of the motors 10 or 80 can be employed to provide pressurized hydraulic fluid to move the piston 94 in the cylinder 92 in one of two opposite directions at a first speed. Alternatively, both motors 10 and 80 can be employed, thereby driving the piston in the desired direction at a second, higher, speed. This construction of the power pack unit affords both redundancy and variable drive speeds for the actuator 90.

Figure 4:
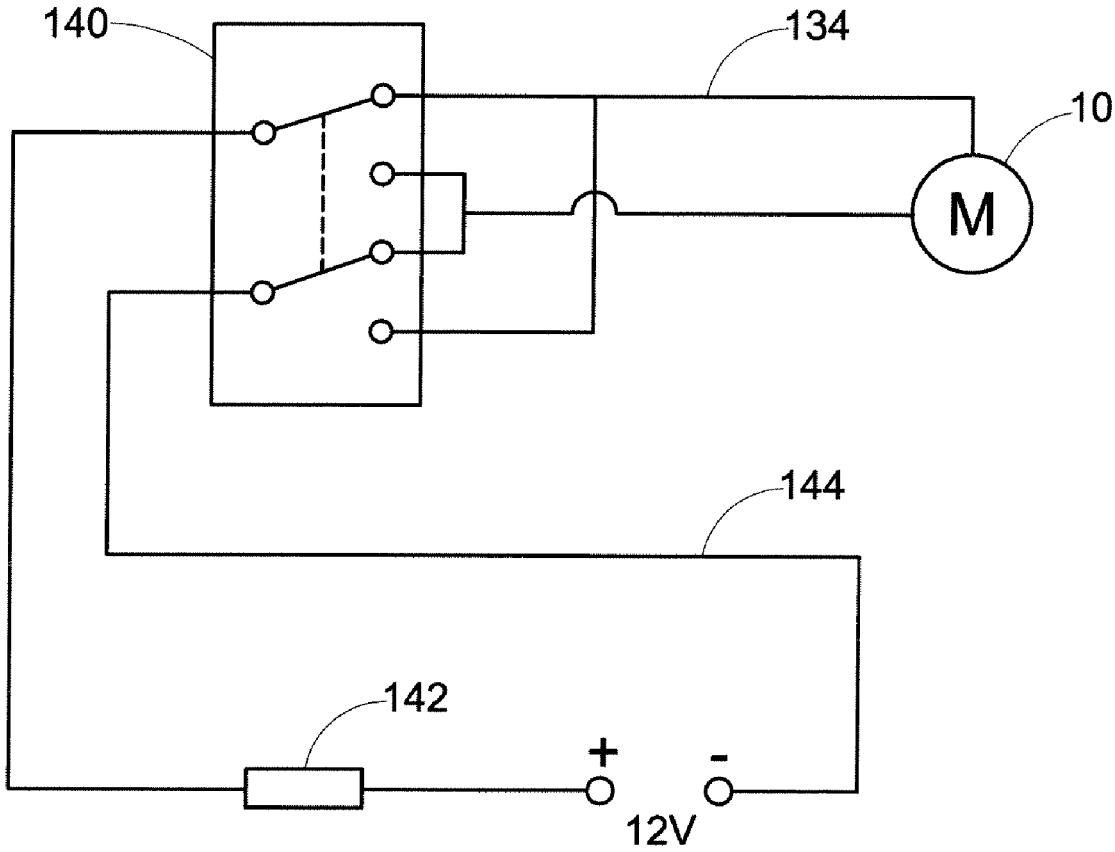
FIG. 4 is an electrical circuit diagram of a control unit for a portion of the power pack unit of FIG. 1.

With reference now to FIG. 4, in one embodiment, the control box can include a switch 140 which selectively actuates, for example, the motor 10. The switch 140 communicates with a power supply via electric lines 142, in which there can be located a fuse 144. It can be seen that moving the switch 140 will reverse polarity and, hence, reverse the rotational direction of the motor 10. The switch can be a conventional rocker switch of the type sold by Carling as Model No. VLD1S00B. It should be appreciated that each motor 10, 80 can be a 12 volt motor, which is the reason why a 12 volt power supply is illustrated in FIG. 4.

Figure 5:
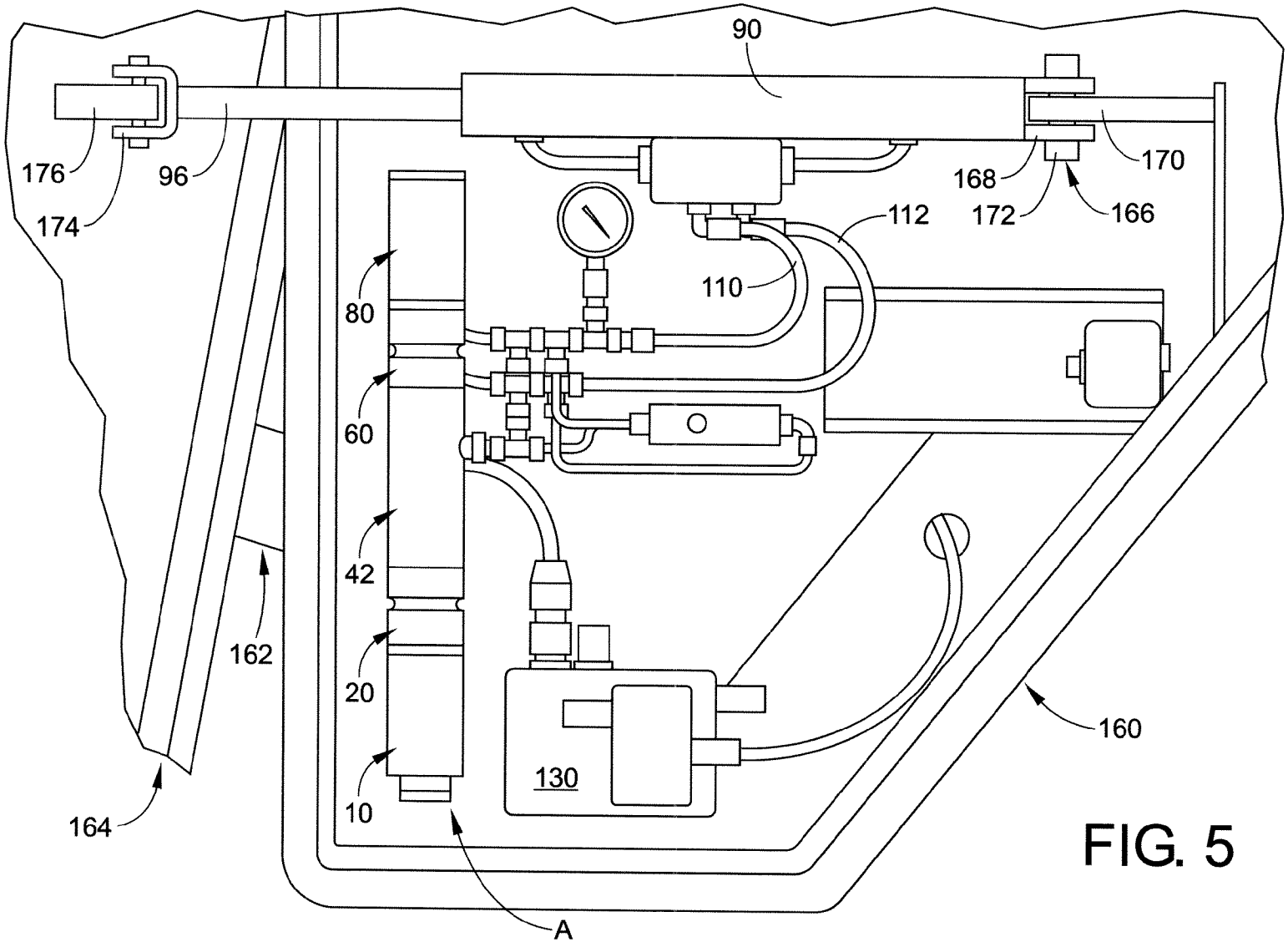
FIG. 5 is a perspective view of an embodiment of the power pack unit of FIG. 1 in use to assist in the movement of a vehicle door.

With reference now to FIG. 5, the power pack unit can be used to selectively move a door 160 of a vehicle to an open position or a closed position, as desired. The door 160 can be mounted by suitable conventional hinges 162 to a frame 164 of the vehicle. It can be seen that the actuator unit 90 can be positioned in the door, as can the power pack unit A. More particularly, the actuator unit 90 can be connected via a pivot connection 166 to the door 160. To this end, the pivot connection can comprise a clevis 168 connected to the cylinder 92 and a hinge member 170 mounted to the door. A hinge pin 172 can extend through aligned apertures in the clevis 168 and the hinge member 170.

A piston rod end 96 of the actuator unit 90 can include a mounting member 174 pivotally connected to a mounting element 176 secured to the vehicle frame 164. In this embodiment, the power pack unit A can be used to selectively actuate the piston and cylinder unit 90 in order to assist in opening and closing the door 160 of the vehicle. It should be appreciated that in this embodiment, the power pack unit A and the actuator unit 90 are disposed along a different longitudinal axes. This is simply due to the structure of the door 160. If, however, the power pack unit and actuator were used on a different vehicle body component, perhaps a large tailgate or the like, the two units could be aligned axially. Moreover, in the embodiment illustrated in FIG. 5, the two units are oriented approximately perpendicular to each other. However, in a different embodiment, the two could be aligned along parallel axes, if so desired. It should be appreciated that the interior door skin is removed from the embodiment illustrated in FIG. 5. Thus, the power pack A and the actuator 90 would be hidden behind the interior door panel or skin during normal use. One of the advantages of the design illustrated in FIG. 5 is that the power unit or power pack A has a compact diameter in relation to its pressure output. Therefore, a smaller diameter package offering the same hydraulic power as a unit with a single larger motor is provided. But, since the package is smaller in diameter, it can fit in spaces which would be too small or too narrow to accommodate a single unit with the same hydraulic power. The inline arrangement also enables the power pack unit to be mounted in the restricted space afforded by the interior of a vehicle door.

Performance specifications to consider when selecting hydraulic power units include operating pressure, flow, total power and reservoir capacity. The operating pressure is the pressure the power unit can deliver at the outlet. The pressure of the power unit may be expressed as a single pressure rating or it can be rated to operate over a range of pressure. For example, the power unit can have a range of 600-2,500 psi. The fluid flow through the power unit may be a single rating or have low and high rating points. In one embodiment, the fluid flow can be on the order of one gallon per minute. The total amount of power the motor/pump can draw, or as rated to operate can be, for example, 20 amps at 12 volts or 10 amps at 24 volts.

Such power units or power packs can have multiple power sources, so that the necessary power can be available from any desired source or a combination of sources. In addition to electric motors as disclosed in the embodiment of FIGS. 1-5, such power units could be driven by other types of motors, such as internal combustion motors or the like. Power is measured in horsepower or similar units. These power units can range from 0.03 horse power to 0.40 horse power with the currently used electric motors. Of course, with larger electric motors, the power units can have a higher horse power, such as one, two or three horse power, or even larger. The capacity of the power unit reservoir is measured in gallons, cubic centimeters, or similar units. For example, the design illustrated in FIGS. 1 and 2 can have a capacity of 396 cubic centimeters (cc). Of course, the units may have reservoirs with a range of capacities. For example, if the reservoir is, for example, 20 inches long, then the capacity can be up to 1500 cc. Larger reservoirs are also contemplated. The displacement of the pumps 20 and 60 can, in one embodiment, be 0.35 cc. While such a displacement is adequate for the compact unit disclosed in FIGS. 1 and 2, different, larger, displacements are contemplated for larger power units.

Physical specifications to consider for hydraulic power units include the pump type, power source, cooling method and available space for mounting the unit. All hydraulic power units have some type of integrated pump. A particular type of gear pump has been illustrated in the first embodiment discussed above. However, there are many other types of pumps available as well. Some units are available with multi-stage pumps which perform like multiple pumps connected in series. Pump types available for hydraulic power units includes single stage, double stage, three or more pump stages and multiple pump units. Power sources include not only electric motors, such as has been disclosed above in the first embodiment, but also diesel engines, gasoline engines and pneumatic compressors.

Some power units are cooled, such as by heat exchanger or fan driven oil coolers. Other power units are only cooled passively by radiation and convection. Another important consideration for power units is their unit weight. In the embodiment illustrated in FIG. 5, it is noted that the cylinder is not axially aligned with the power pack. One reason for this is that such a system would likely be too long for the vehicular door application illustrated in FIG. 5. In the door system illustrated in FIG. 5, the power unit would be actuated via a toggle switch or the like (such as is shown in FIG. 4) to move the door from one position to another.

Figure 6:
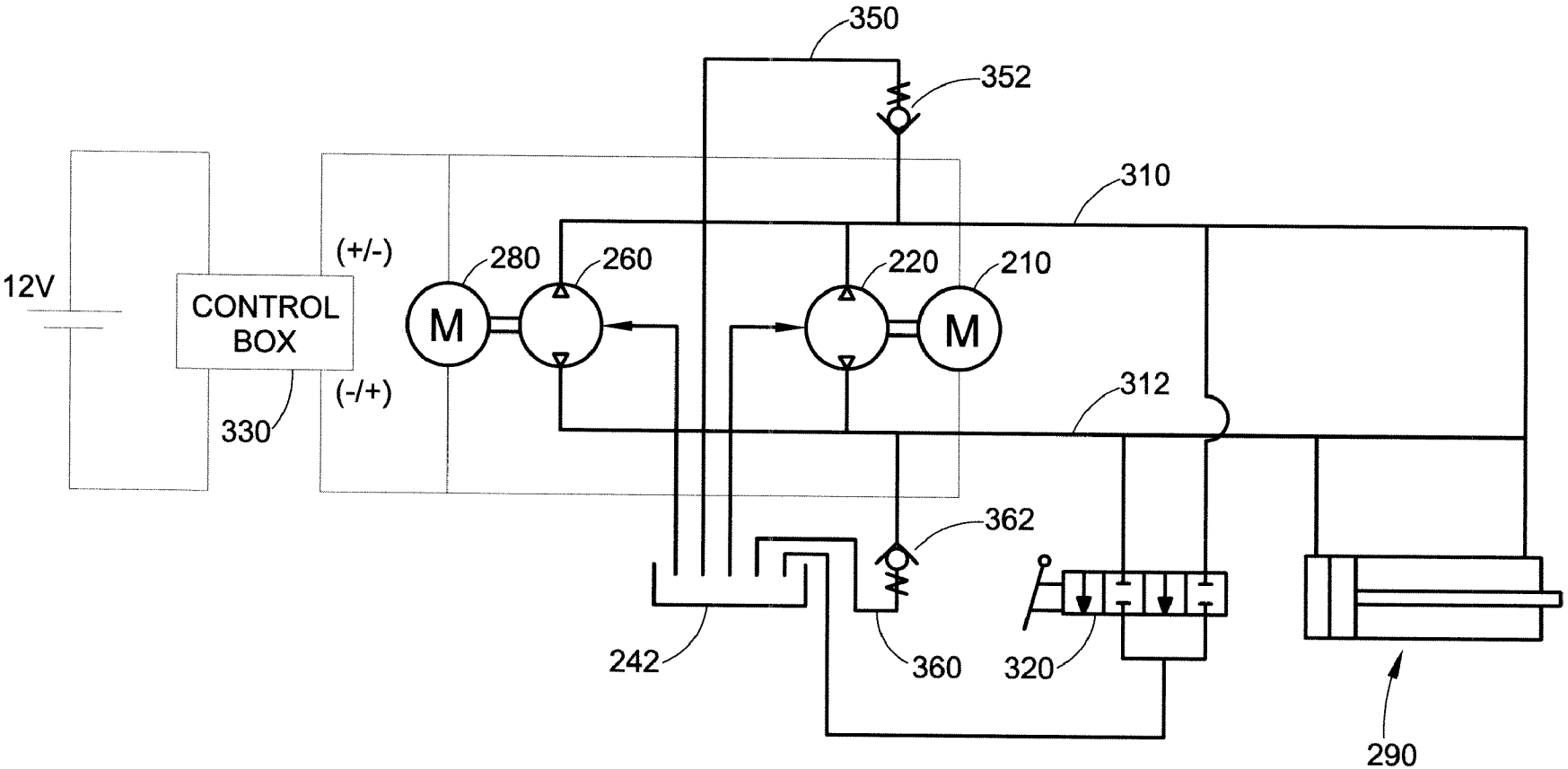
FIG. 6 is a hydraulic and electrical circuit diagram of a second embodiment of the present disclosure.

With reference now to FIG. 6, another embodiment of the present disclosure is there illustrated. In this embodiment, there is provided a first motor 210 which drives a first pump 220 and a second motor 280 which drives a second pump 260. It is noted that both pumps 220 and 260 are illustrated as being bi-directional pumps. Both pumps 220 and 260 draw fluid from a common reservoir 242. If desired, the common reservoir can be positioned between the pumps, as in the embodiment of FIGS. 1 and 2 above. A control box 330 actuates the two motors 210 and 280 and, hence, powers the two pumps 220 and 260. It should be appreciated that the control box can include a microprocessor and appropriate software in a memory to allow the control box to direct the operation of the motors.

In this embodiment, the two pumps 210 and 260 communicate with a cylinder unit 290 via suitable hydraulic lines 310 and 312. Also provided is a manual relief valve 320 which similarly communicates with the reservoir 242. Further communicating with the reservoir 242 and the first hydraulic line 310 is an additional hydraulic fluid line 350, in which is located a thermal relief valve 352. A second hydraulic fluid line 360, in which there is also located a thermal relief valve 362, communicates with a second fluid line 312. Thus, this embodiment of the disclosure incorporates thermal relief valves to manage any overpressure of the hydraulic fluid due to heating the fluid used in the system.

Figure 7:
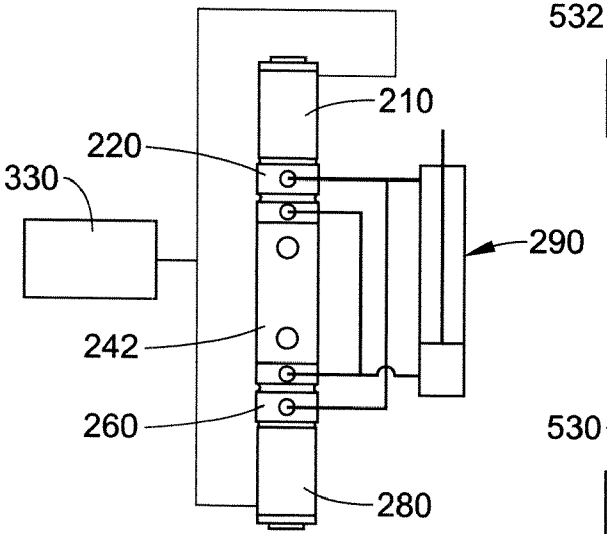
FIG. 7 is another diagram illustrating the single cylinder configuration of the embodiment of FIG. 6.

With reference now to FIG. 7, disclosed therein is a single cylinder configuration of the type previously illustrated in FIGS. 3 and 6. In this configuration, the motors 210 and 280 are connected in parallel and run together at the same speed. Therefore, almost twice the flow of hydraulic fluid is provided by the pumps 220 and 260 to the cylinder 290 as compared to a single power pack unit employing one gear pump driven by an electric motor. This embodiment would use twice the current of a single power pack. However, the pressure rating could be the same as a single power pack. That pressure rating, depending on the motor, could be from 1500 PSI to 2000 PSI. The benefit of this embodiment is that there is provided redundant cylinder operation. If one motor or pump fails, then the other one is capable of moving the load, albeit at about half the speed.

Figure 8:
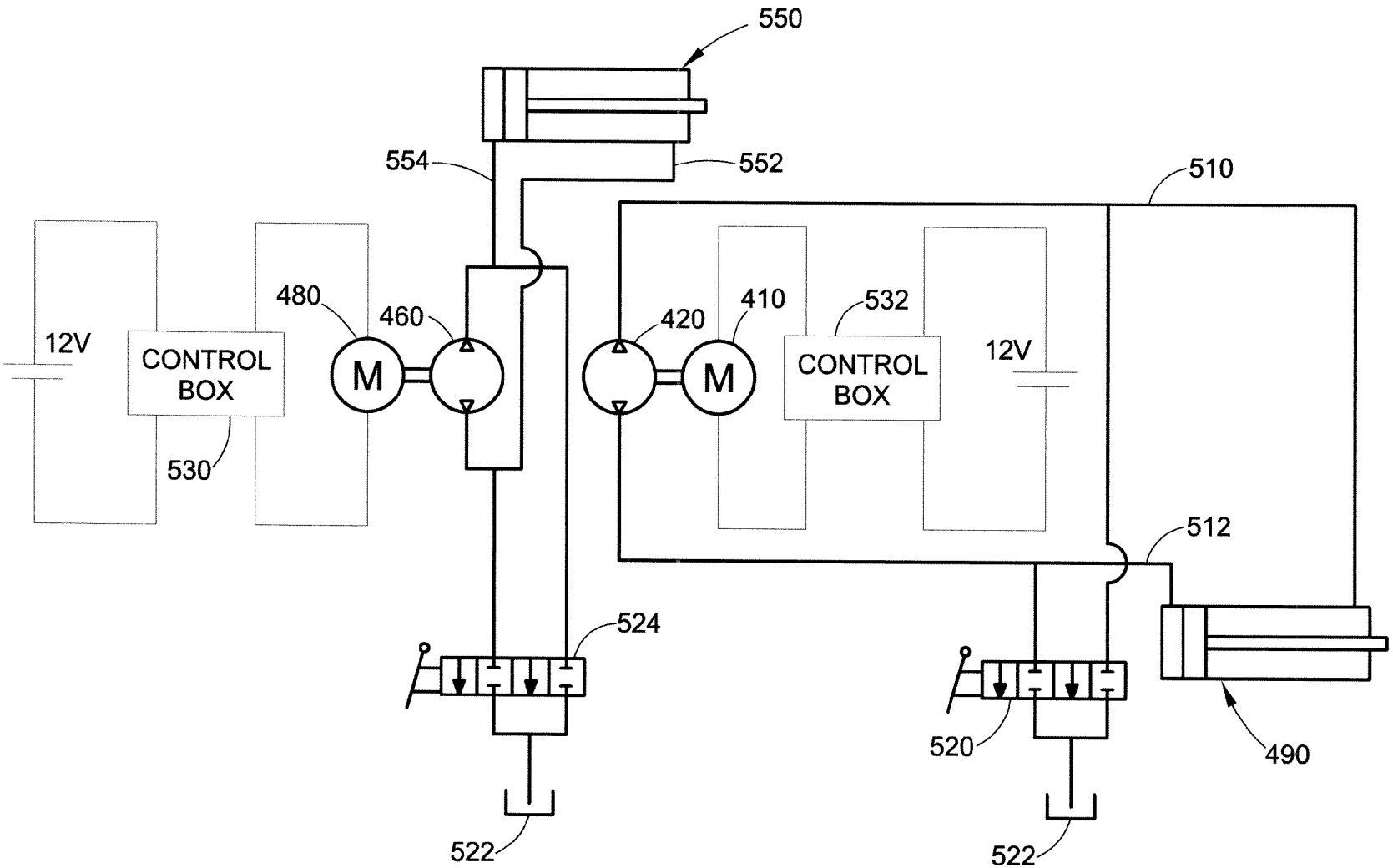
FIG. 8 is a hydraulic and electrical circuit diagram of a third embodiment of the present disclosure.

With reference now to FIG. 8, shown there is another embodiment of the present disclosure. This embodiment comprises a first motor 410 which selectively powers a first pump 420 and a second pump 460 which is selectively powered by a second motor 480. The first pump 420 selectively actuates a first actuator or piston and cylinder assembly 490 via suitable first and second hydraulic lines 510 and 512. Connected to these lines is a first manual relief valve 520. The first pump is powered by the first motor 410 which is controlled by a suitable control box 532.

The second pump 460 is selectively powered by the second motor 480, which is controlled by a separate second control box 530. The second pump 460 communicates with a second actuator or hydraulic piston and cylinder 550 via suitable hydraulic fluid lines 552 and 554. These fluid lines also communicate with a hydraulic reservoir, such as 522, via a manual relief valve 524 if so desired. A common hydraulic fluid reservoir 522 can be provided for both hydraulic circuits if so desired. In one embodiment, the common hydraulic reservoir 522 is positioned between the two pumps 420 and 460 to provide a compact power pack design. Alternatively, two separate hydraulic fluid reservoirs could be employed.

In this embodiment, the two motors 410 and 480 can run at different speeds, or independently, so as to allow the two pumps 420 and 460 to run at different speeds, or independently, as well. As a result, the two actuators 490 and 550 can be operated independently of each other. If the motors are 12 volt DC motors, the power supply for each of them is also at 12 volts. In this embodiment, each control box would be provided with its own switches. Nevertheless, a compact design can be achieved for the power pack system.

In another embodiment, the power pack unit, such as A, can be aligned with a cylinder unit, such as 90, in order to form an actuator. Moreover, the control system 130 could be so configured as to enable the cylinder assembly 90 to be selectively driven by one or both of the hydraulic pumps 20 and 60 should that be desired. It should also be appreciated that if only one of the pumps 20 and 60 is in use, the other pump would be locked. In other words, it would not run in reverse.

Figure 9:
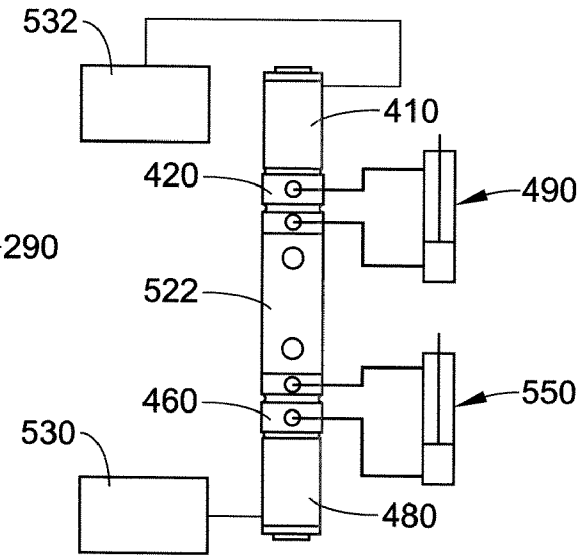
FIG. 9 is another diagram illustrating the independent dual cylinder configuration of the embodiment of FIG. 8.

With reference now to FIG. 9, disclosed therein is an independent dual cylinder configuration, along the lines of the design in FIG. 8. In it, the first pump 420 selectively actuates the first piston and cylinder assembly 490 and the second pump 460 selectively actuates the second piston and cylinder assembly 550. The motors are connected to separate control units 530 and 532 and can, thus, run independently and actuate the cylinders independently.

Figure 10:
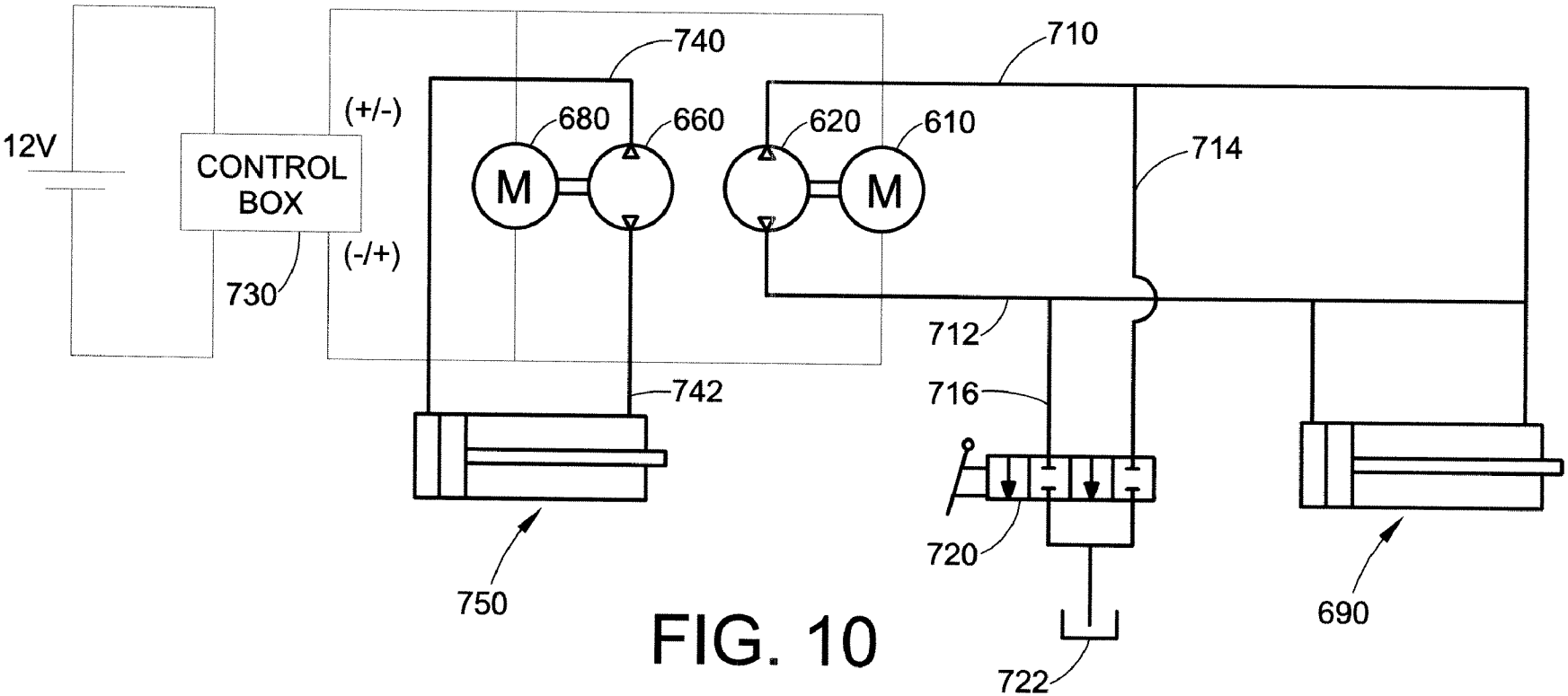
FIG. 10 is a hydraulic and electrical circuit diagram of a fourth embodiment of the present disclosure; and, FIG. 11 is another diagram illustrating the connected cylinder configuration of FIG. 10.

With reference now to FIG. 10, a further embodiment is there illustrated. In this embodiment, there is provided a first pump 620 which is powered by a first motor 610 and a second pump 660 which is powered by a second motor 680. The first pump 620 selectively actuates a first piston and cylinder assembly 690 via suitable first and second hydraulic lines 710 and 712. Connected to these lines is a first manual relief valve 720, via fluid lines 714 and 716. The second pump 660 communicates with a second hydraulic piston and cylinder assembly 750 via suitable hydraulic fluid lines 740 and 742. For ease of understanding, the hydraulic fluid reservoir communicating with the first and second lines 740 and 742 is not illustrated. However, it can be the same as the reservoir 722. Moreover, fluid flow through lines 740 and 742 can be controlled by a suitable valve, such as the valve 720. In this embodiment, the two motors 610 and 680 are controlled by a common control box 730. Therefore, they would be running at roughly the same speed. In order to be fully synchronized, however, the two cylinders 690 and 750 would need to be mechanically linked by a conventional linkage means.

Figure 11:
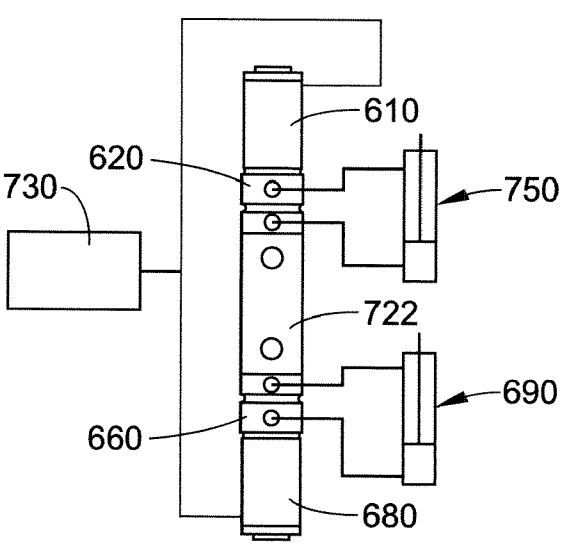

FIG. 11 illustrates such a design. However it does not show the mechanical linkage of the two cylinders 690 and 750.

The disclosure has been described with reference to several embodiments. Obviously, modifications and alterations will occur to others upon a reading and understanding of this specification. It is intended to include all such modifications and alterations insofar as they come within the scope of the appended claims or the equivalents thereof.

The invention claimed is:

1. A power pack unit comprising:

a first hydraulic pump;

a first motor which mechanically drives said first hydraulic pump;

a second hydraulic pump;

a second motor which mechanically drives said second hydraulic pump;

a hydraulic fluid reservoir defined within a hydraulic fluid reservoir housing, the hydraulic fluid reservoir housing being positioned between and adjacent to the first and second hydraulic pumps, the hydraulic fluid reservoir fluidly communicating with the first and second hydraulic pumps;

the first and second hydraulic pumps, the hydraulic fluid reservoir housing, and the first and second motors being arranged to extend along a common axis;

the first and second hydraulic pumps being exterior to the hydraulic fluid reservoir thereby establishing a distance between the first and second hydraulic pumps measured along the common axis through the hydraulic fluid reservoir; and, a suction tube for supplying hydraulic fluid to the first hydraulic pump, the suction tube extending into the hydraulic fluid reservoir from the first hydraulic pump toward the second hydraulic pump a distance at least 50% of the established distance between first and second hydraulic pumps.

2. The unit of claim 1 wherein at least one of said first and second hydraulic pumps comprises a bidirectional pump.

3. The unit of claim 1 further comprising a control system for selectively actuating at least one of the first and second motors.

4. The unit of claim 1 wherein at least one of said first and second motors comprises an electric motor.

5. The unit of claim 1 wherein said first motor is located on a distal end of said first hydraulic pump and said second motor is located on a distal end of said second hydraulic pump.

6. The unit of claim 1, wherein the hydraulic fluid reservoir housing comprises a tubular structure, at least one of the first or second pumps being at least partially telescopically received within the hydraulic fluid reservoir housing.

7. The unit of claim 6, further comprising a seal element for sealing a radially inner surface of the hydraulic fluid reservoir housing to a radially outer surface of the at least one of the first or second pumps.

8. The unit of claim 6, wherein the hydraulic fluid reservoir housing is cylindrical, and wherein the first and second pumps are partially telescopically received in respective ends of the hydraulic fluid reservoir housing, whereby the hydraulic fluid reservoir housing and pumps define an interior volume of the hydraulic fluid reservoir.

9. The unit of claim 1 wherein said first hydraulic pump includes a first pump enclosure accommodating a pump cartridge.

10. The unit of claim 9 wherein said pump cartridge comprises a bidirectional pump unit.

11. The unit of claim 9 further comprising:

a first pressure/return port located on said first pump enclosure;

a second pressure/return port located on said first pump enclosure and spaced from said first pressure/return port; and, a suction port located on said first pump enclosure and communicating with said reservoir.

* * * * *